US007841448B2

(12) United States Patent
Lair

(10) Patent No.: US 7,841,448 B2
(45) Date of Patent: Nov. 30, 2010

(54) AUTOMATIC LADDER FOR ATTIC ACCESS

(75) Inventor: Jean-Pierre Lair, 127 Paddington Way, San Antonio, TX (US) 78209

(73) Assignee: Jean-Pierre Lair, San Antonio, TX (US)

( * ) Notice: Subject to any disclaimer, the term of this patent is extended or adjusted under 35 U.S.C. 154(b) by 908 days.

(21) Appl. No.: 11/671,925

(22) Filed: Feb. 6, 2007

(65) Prior Publication Data

US 2007/0181364 A1 Aug. 9, 2007

Related U.S. Application Data

(60) Provisional application No. 60/765,766, filed on Feb. 6, 2006.

(51) Int. Cl.
*E06C 9/06* (2006.01)

(52) U.S. Cl. ..... 182/77; 182/78

(58) Field of Classification Search ..... 182/77–80, 182/95, 97, 98, 99, 208
See application file for complete search history.

(56) References Cited

U.S. PATENT DOCUMENTS 1,811,707 A 6/1931 Bessler
1,811,708 A 6/1931 Bessler
1,811,820 A 6/1931 Bessler
1,858,981 A 5/1932 Bessler
1,867,904 A 7/1932 Bessler
1,930,992 A 10/1933 Bessler
2,593,336 A 4/1952 Nixon
3,789,955 A 2/1974 Knapp
6,349,793 B1 * 2/2002 Kincaid ..... 182/69.4
6,802,392 B1 10/2004 Davis
6,866,118 B1 * 3/2005 Battenberg ..... 182/77
6,886,661 B1 5/2005 Battenberg

* cited by examiner

*Primary Examiner*—Katherine W Mitchell
*Assistant Examiner*—Daniel Cahn
(74) *Attorney, Agent, or Firm*—Thompson & Knight LLP

(57) ABSTRACT

An access panel is shown in the present invention to provide easy and safe access to an attic space or elevated structure. The access panel is fully automatic. During opening, the access panel only uses gravitational forces for opening a cover. Only during closing is the access panel motorized. The gravitational forces are used to both open the cover and extend the ladder sections, while the motor is only used to retract the latter sections and close the cover. A stow latch keeps the cover closed during non-use. A safety switch keeps the access panel from accidentally opening and the ladder sections from lowering if the stow latch is released. A mechanical lock keeps the cover open when the ladder sections have been lowered.

29 Claims, 14 Drawing Sheets

AUTOMATIC LADDER FOR ATTIC ACCESS

CROSS REFERENCE TO RELATED APPLICATIONS

This is an original non-provisional application claiming benefit of U.S. Provisional Application 60/765,766, filed Feb. 6, 2006, which is incorporated herein by reference.

BACKGROUND OF THE INVENTION

1. Field of the Invention

The present invention relates to an automatic retractable ladder that is installed on an access panel hinged on a framing structure that surrounds an opening into the ceiling for access to an attic space. The access panel and the retractable ladder have two positions. In the first position the access panel automatically closes the opening into the ceiling and the retractable ladder is stowed or retracted on top of the access panel, i.e. in the attic. In the second position the access panel automatically uncovers the opening of the ceiling and the retractable ladder automatically deploys or extends to reach the ground. The automatic opening of the access panel and the automatic deploying of the retractable ladder are achieved through gravity, without assistance of a motorized apparatus, after the release of safety latches. The automatic closing of the access panel and the automatic stowing of the retractable ladder are achieved through a single motorized apparatus. The latching of the access panel in its closed position is achieved automatically and mechanically.

2. Description of the Related Art

Ladders for attic access are widely used by the people in their private homes. Attic accesses are usually provided above the garages and/or living quarters of private homes. The most common attic access consists of an access panel, spring loaded in the closed position and hinged on a wooden structure frame surrounding an opening in the ceiling and installed in the ceiling. To get access to the attic, a user would pull on a piece of rope attached to -the panel and hanging therefrom. This opens the panel, giving access to a folded ladder. The ladder is usually composed of three sections that are folded on top of each other and hinged between each other. The first section is attached to the panel. To deploy the ladder, a user needs to manually grasp the folded second and third sections, rotates this assembly to the deployed position and finally grasp the third section to manually unfold it from the second section. Once the unfolding is achieved, the three sections of the ladder are usually extended in alignment enabling a user to access the attic space. The opposite process needs to be followed by the user for the refolding of the ladder. For re-closing the panel, the user needs to push firmly on the panel moving the panel up to a couple of inches from the ceiling. At such point the springs of the panel take over and move the panel to its fully closed position.

The experience shows that the drawbacks of these attic access systems reside in the difficulty of the steps that need to be performed for the opening of the panel, i.e., the unfolding of the ladder, the refolding of the ladder and the re-closing of the panel. While the procedure appears to be easy for a male, provided he is tall, strong and not impaired, the procedure is difficult for a female and virtually impossible as well as potentially dangerous to any elderly person.

U.S. Pat. No. 6,866,118 describes a ladder that can be extended and retracted by an electric motor. While the technology described appears to be an improvement over the manual attic ladders mentioned previously, its complexity makes it impracticable and too costly for industrial or private home applications.

It would consequently be of great advantage to provide a system giving easy and safe attic access to everyone at a low cost.

BRIEF SUMMARY OF THE INVENTION

The present invention overcomes the drawbacks of the prior art by providing a fully automatic access to an attic. More particularly, the invention is composed of an access panel that is hinged towards the forward end of a frame structure that supports sections of ladders. The frame structure supports in its aft end part of the mechanism that unlatches the panel, controls its opening, controls the deployment of the sections of ladders, retracts the ladder and closes the panel and re-latches it on the fixed frame. More particularly, while the invention uses gravity for the opening of the panel and for the extension of the sections of ladders, it uses a single electric motor mounted at the aft end of the framing structure for performing the retraction of the ladders and the closing of the panel. The relatching of the panel and its associated sections of ladders in the stowed position is purely mechanical, i.e., without the assistance of electric energy.

The stow latch performs the function of maintaining the panel and its associated sections of ladders in the closed position.

The safety latch performs the function of controlling the opening of the panel and the extension of the sections of ladders to the ground.

The single electric motor performs two distinct functions. The first function is to retract the sections of ladders to their stowed position after they have been extended to the ground, and the second function is to close the panel.

In one exemplary embodiment of the invention, there is one electric solenoid for controlling the unlatching of the stow latch and one electric solenoid for controlling the unlatching of the safety latch. Both latches are equipped with a manual override. In another embodiment of the invention, the unlatching of both latches is only achieved manually.

It is a characteristic of this invention that the electric motor is only energized to retract the sections of ladders and to close the panel to its stowed position. The electric motor is not energized to either open the panel, or to extend the sections of ladders, or to maintain the panel in its stowed position. The shaft of the electric motor is equipped with a gear that drives a single gear free-wheel. The single gear free-wheel is free to rotate in one direction and is driven by the electric motor in the opposite direction. The single gear free-wheel is mechanically connected to two concentric shafts, the inner shaft being supported by the framing structure while the outer shaft supports one spool on each end thereof. The outer shaft is free to rotate in one direction and is driven by the electric motor in the opposite direction. One end of the cables is rolled up on, and attached to, each of the spools. The other extremity of the cables is attached to the last section of the ladder. In the free direction of rotation of the outer shaft, the spools unroll their dedicated cables allowing the opening of the access panel and subsequently the deployment of the sections of ladders. In the other direction of rotation of the shaft, the spools roll up the cables allowing the retraction of the sections of ladders and lastly the closing of the access panel.

In one embodiment of the invention there is an automatic mechanical locking of the access panel in its fully opened position, once the sections of ladders have departed from their fully retracted position. This is to require the re-stowing of the ladder before the closing of the panel.

In another embodiment of the invention, there is no mechanical locking of the access panel in its fully opened position.

The ladder of the invention is at least composed of two distinct sections that are engaged in a sliding arrangement. Depending of the height of the ceiling, the number of sections can be increased. The figures accompanying the detailed description of the invention show three sections of ladders. The first ladder section is mechanically attached to the access panel, the second ladder section is arranged to slide on top of the first ladder section, and the third ladder section is arranged to slide on top of the second ladder section. Mechanical stops are provided on each of the ladder sections for limiting the sliding stroke.

The invention, in accordance with preferred and exemplary embodiments, together with further objects and advantages thereof, is more particularly described in the following detailed description taken in conjunction with the accompanying drawings.

DETAILED DESCRIPTION OF THE INVENTION

In the following detailed description, reference is made to the accompanying drawings, which form a part hereof and are shown by way of illustration specific embodiments in which the invention may be practiced. These embodiments are described in sufficient detail to enable those skilled in the art to practice the invention. It is understood that other embodiments may be utilized without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
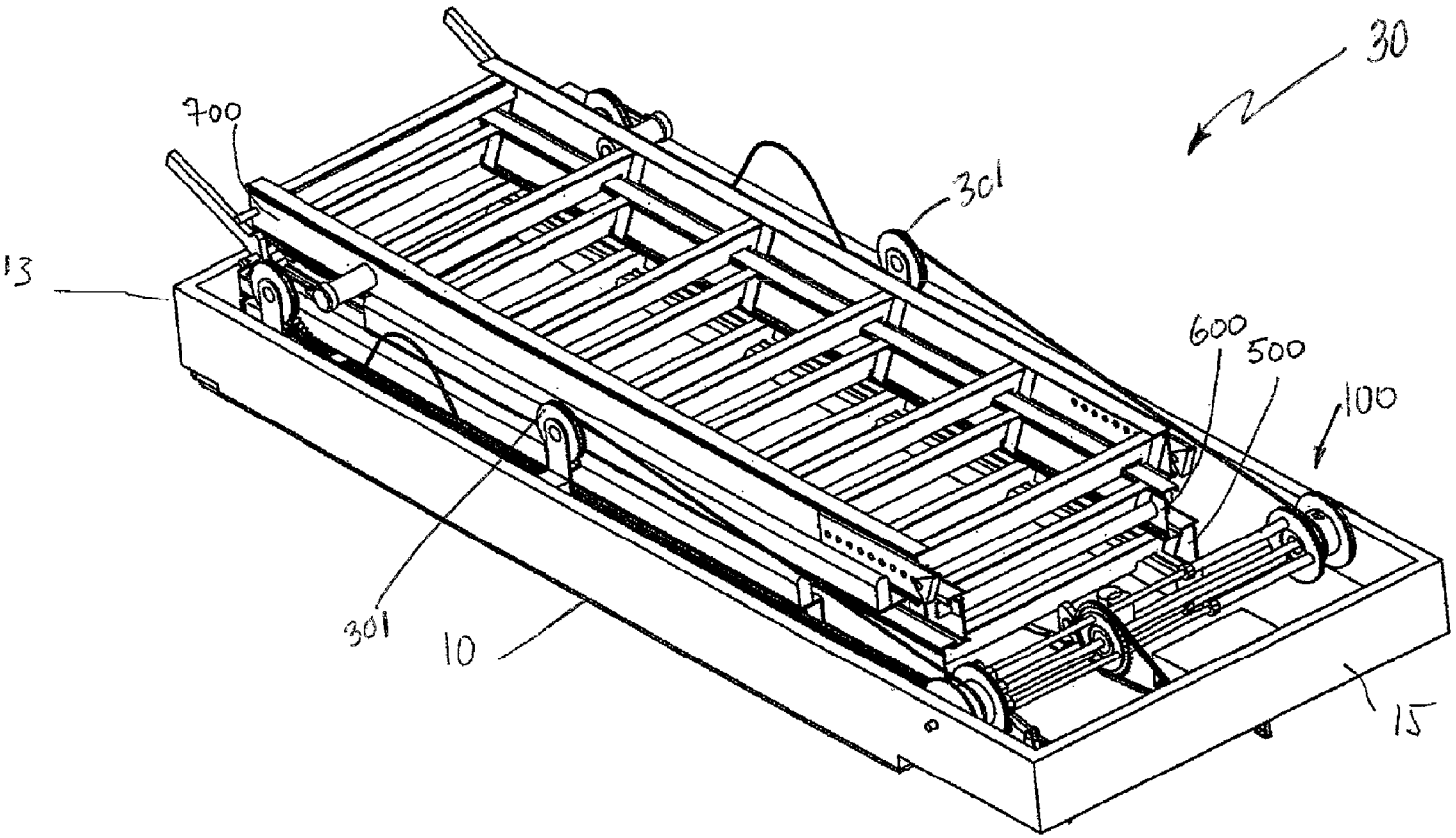
FIG. 1 is a perspective view of an access panel shown in its stowed position.
Figure 2:
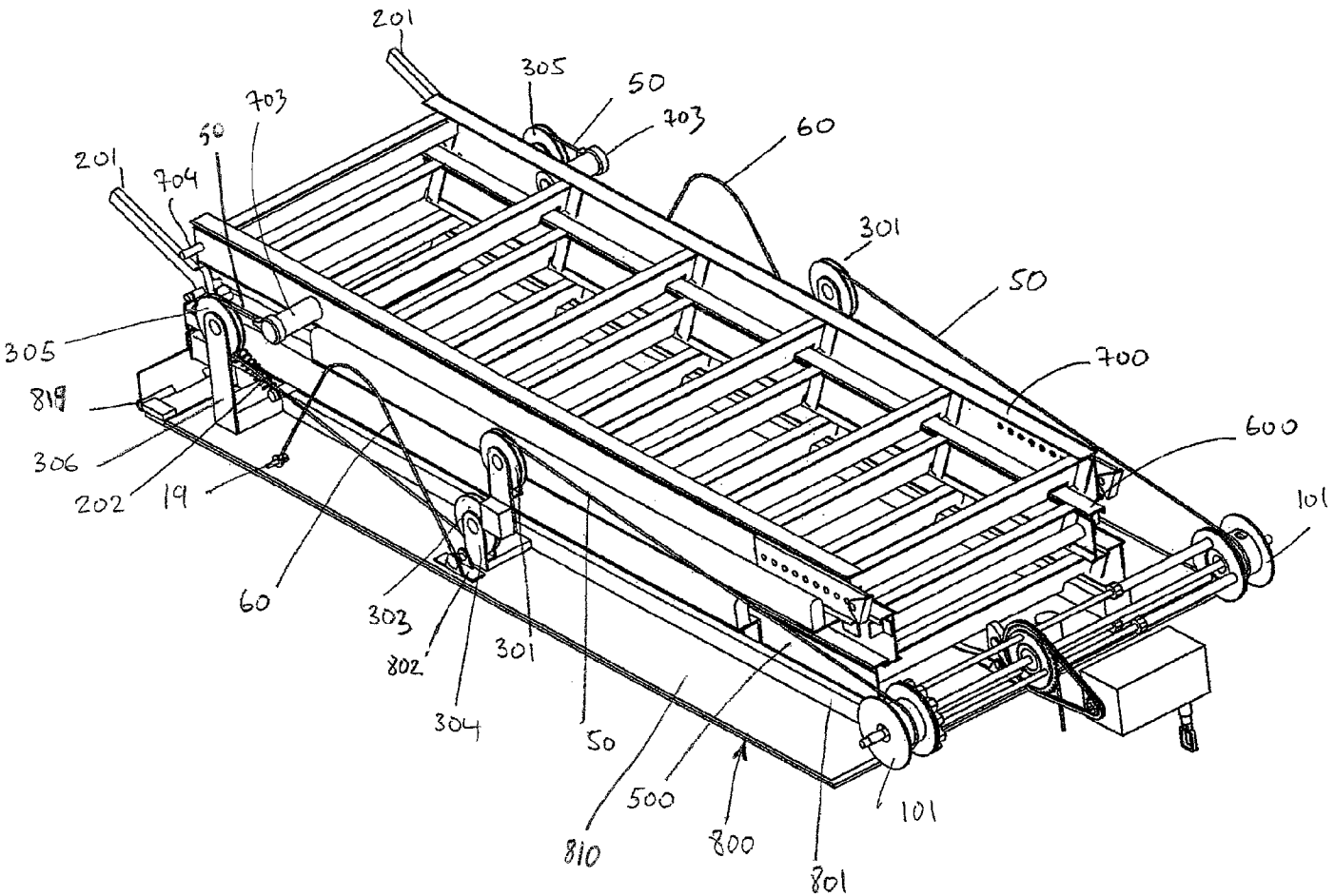
FIG. 2 is a perspective view of the access panel shown in FIG. 1 with the framing structure removed.
Figure 12:
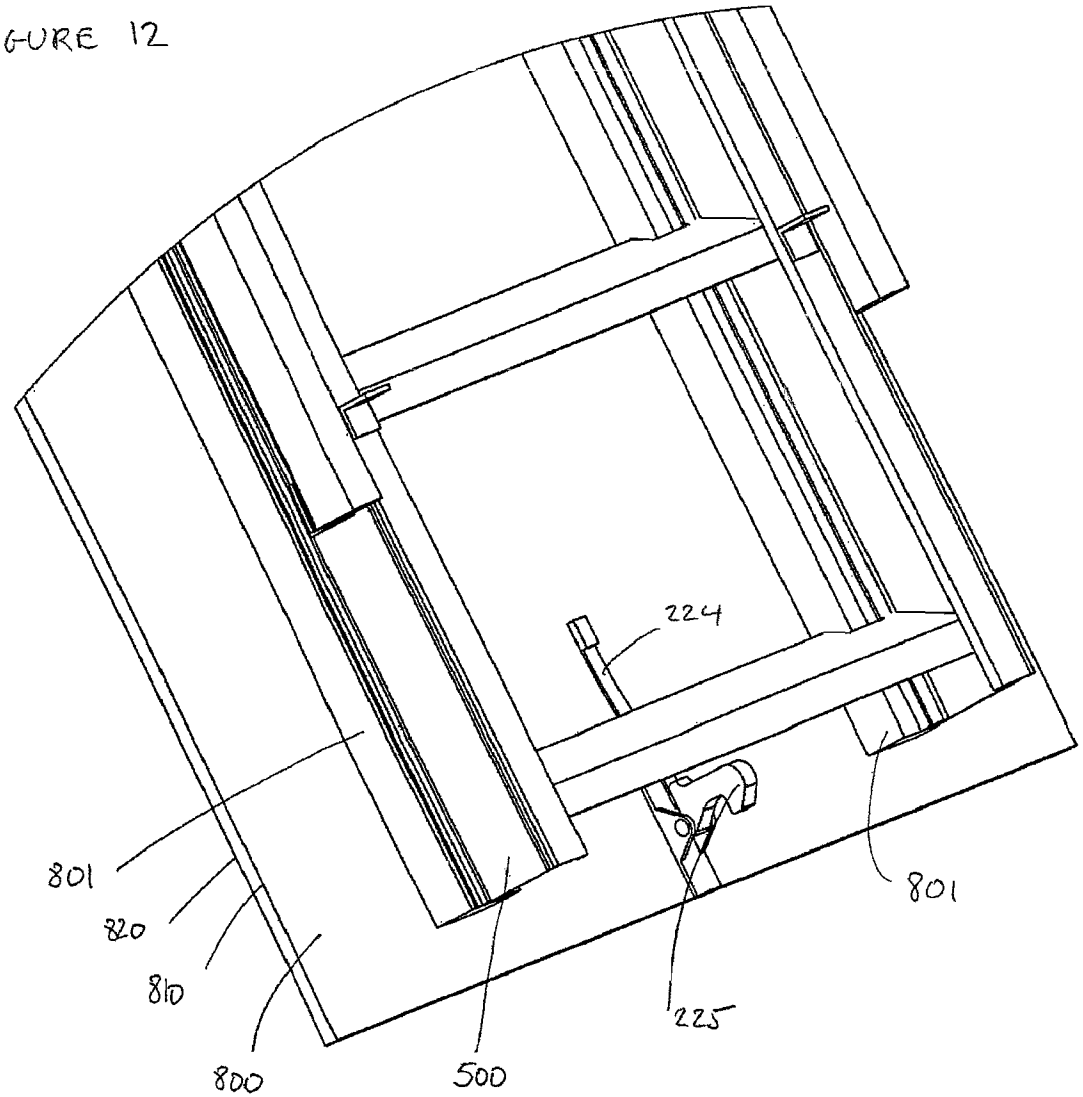
FIG. 12 is a partial perspective view of the first ladder section and the cover of the access panel.

With reference to FIG. 1, the ladder sections 500, 600, 700 of access panel 30 are shown in their retracted and stowed position. The ladder sections 500, 600, 700 are mounted on a frame structure 10. With reference to FIG. 2 where the framing structure 10 is removed for clarity, the first ladder section 500 is spaced away from the inner surface 810 of the cover 800 (See FIG. 12). Beams 801 are mechanically attached to the cover 800. In this manner, the climbing of the steps of ladder 500 is not affected by the presence of the cover 800. In other words, the resting position of the feet of the user of the ladder portions of the access panel 30 remains the same whether the user is on ladder sections 700, 600 or 500. This allows each step of the ladder sections to have the same depth, and this provides to the user the same position of steps against his feet regardless of which section of the ladder he is standing on.

There are many manual retractable ladders that are commonly used in the industry, and more particularly in the construction industry. These ladders are composed of different sections that are arranged to slide on one another so that they can be extended and retracted. However the steps of these ladders are usually composed of a plurality of rungs. Such a step configuration would be neither comfortable nor safe for everyone to use. Therefore, as shown on FIGS. 2, 9, 6, 7, 8, 9, 10, 11, and 12, all the steps have a comfortable width for the security of the person climbing of each of the sections.

With reference to FIG. 2 the ladder sections 500, 600, 700 are configured to allow a longitudinal sliding motion between each other. Section 500 is mechanically attached to cover 800 and spaced from it by beams 801. Section 600 is configured to slide longitudinally on top of, but inside, section 500. Section 700 is configured to slide longitudinally on top of, but outside, section 600. No further description of the sliding arrangement is made as this is a very well known and used in industrial ladders technology.

Cover 800 that supports the ladder sections 500, 600, 700 is hinged via hinge 819 on forward end 13 of the framing structure 10 (See FIGS. 1 and 2). Since ladder section 500 is mechanically attached to cover 800, the hinge 819 can alternatively be installed between ladder section 500 and forward end 13 of framing structure 10.

Still in reference to FIG. 2, one end of cables 50 is attached to reels 101 while their other end is attached to bars 703 of ladder section 700. Cables 50 are guided by pulleys 301 hinged on the framing structure 10 (See FIG. 1), the pulleys 303 hinged on cover 800 and pulleys 305 hinged on ladder section 500. Clevis supports 304 of pulleys 303 are located such that the portion of the cables 50 that is guided by pulleys 301 and 303 is substantially vertical. This decreases the force required for the closing of the cover 800. Pulleys 305 are supported by clevis fittings 306 that are mechanically attached to either the forward portion of ladder section 500 or the forward portion of the cover 800. Retainer cables 60 have one end attached to bolts 19 that are mechanically attached to longitudinal sides 11 and 12 of framing support 10 (See FIG. 3). The other end of cables 60 is hinged on clevis fitting 802 that is mechanically attached to the cover 800.

Still in reference to FIG. 2, the locks 201 have been moved away from their locked position by the rod 704 that is mechanically attached to ladder section 700. The locks 201 are spring loaded via springs 202 towards their locked position, and their function is to lock the cover 800 to its full opened position when the ladder sections 600 and/or 700 have moved away from their retracted position.

Figure 3:
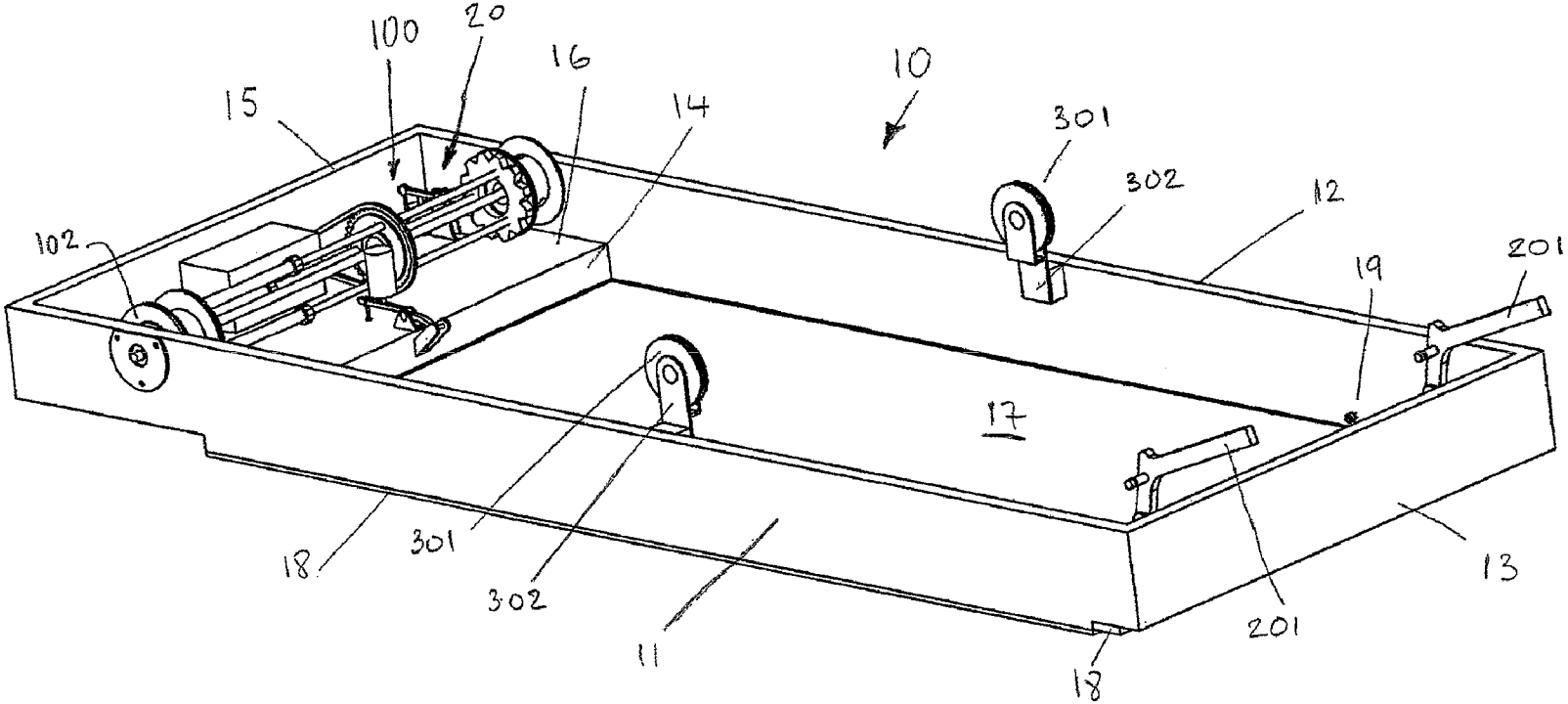
FIG. 3 is a perspective view of the framing structure equipped with a driving mechanism.

With reference to FIG. 3, the framing structure 10 that supports the ladder sections 500, 600, 700 has a forward end 13, a intermediate distal end 14 and an aft end 15. The three ends 13, 14, 15 are bordered by two identical longitudinal opposite sides 11 and 12. There is a central through opening 17 disposed between the forward end 13 and intermediate distal end 14 and the longitudinal sides 11 and 12. There is no central through opening between intermediate distal end 14 and aft end 15 and the longitudinal sides 11 and 12; however, there is a cavity 20 that has a floor 16. This cavity 20 houses the latching system (as will be subsequently described), the safety system and the driving mechanism 100 of the apparatus of the invention. Still in reference to FIG. 3, the forward end 13 provides the support for locks 201, the function of which is described later. The longitudinal sides 11 and 12 support the driving shafts of the braking system 102, the devices 302 which support pulleys 301, and the bolts 19 of the retainer cables 60 (FIG. 2). The lower faces of the longitudinal walls 11 and 12 and of the forward end 13 and intermediate distal end 14 are fitted with a seal 18 that is sandwiched by cover 800 when in its closed position. In this manner, should the access panel 30 be installed in a ceiling of a room that has a atmospheric controlled environment, energy spending is minimized.

Figure 6:
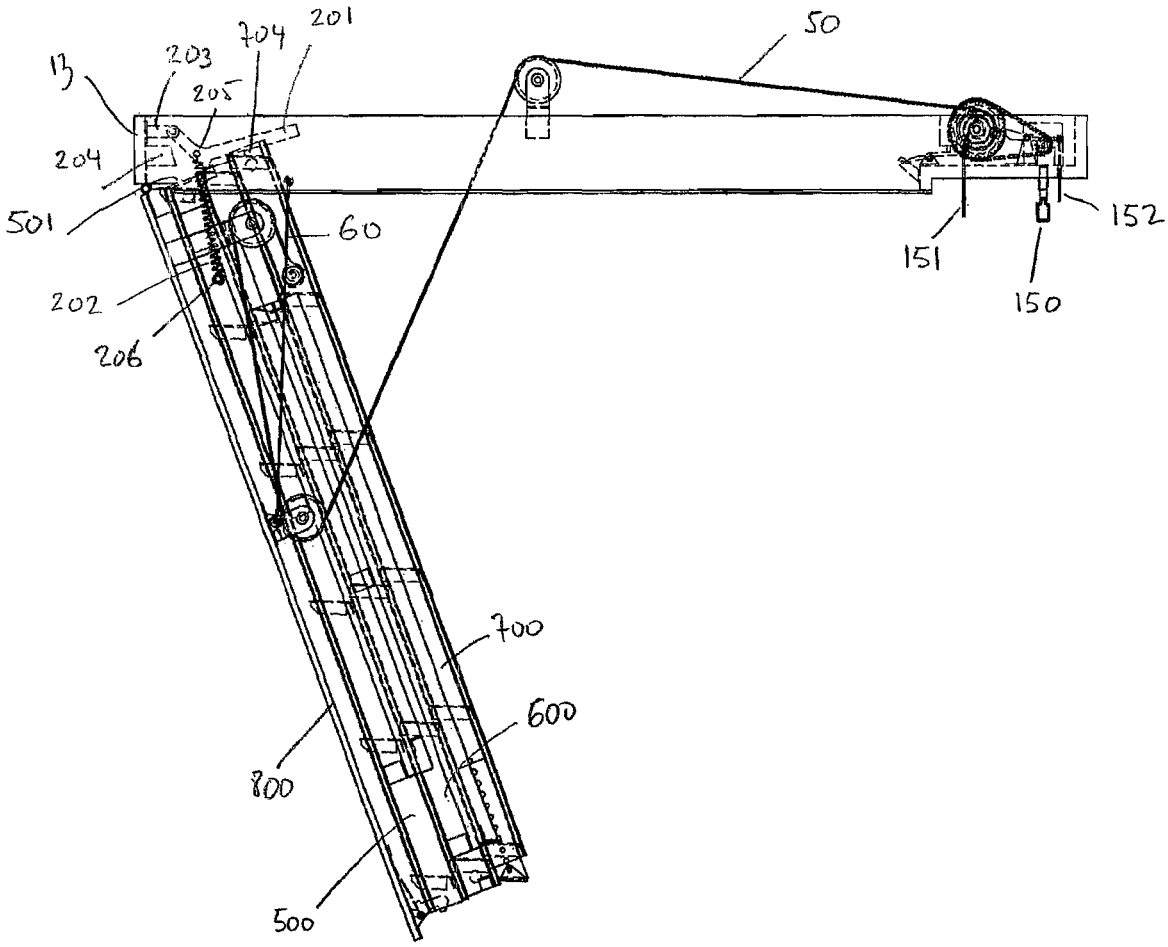
FIG. 6 is a side view of the access panel shown in the opened position, with sections of the ladder being retracted, hidden items being shown in dotted lines.

With reference to FIG. 6, the cover 800 is shown in its full opened position. Cover 800 cannot open further because it is retained by cables 60. Pulled by springs 202, the mechanical locks 201 have started to pivot on mounting devices 203 that are mechanically attached to forward end 13. One end 205 of the springs 202 is attached to the locks 201 while the other end 206 is attached to rod 503 of ladder section 500 (See FIG. 9). In this position the mechanical locks 201 have hot yet reached their latched position because the ladder section 700 has not moved away from its retracted position.

Figure 7:
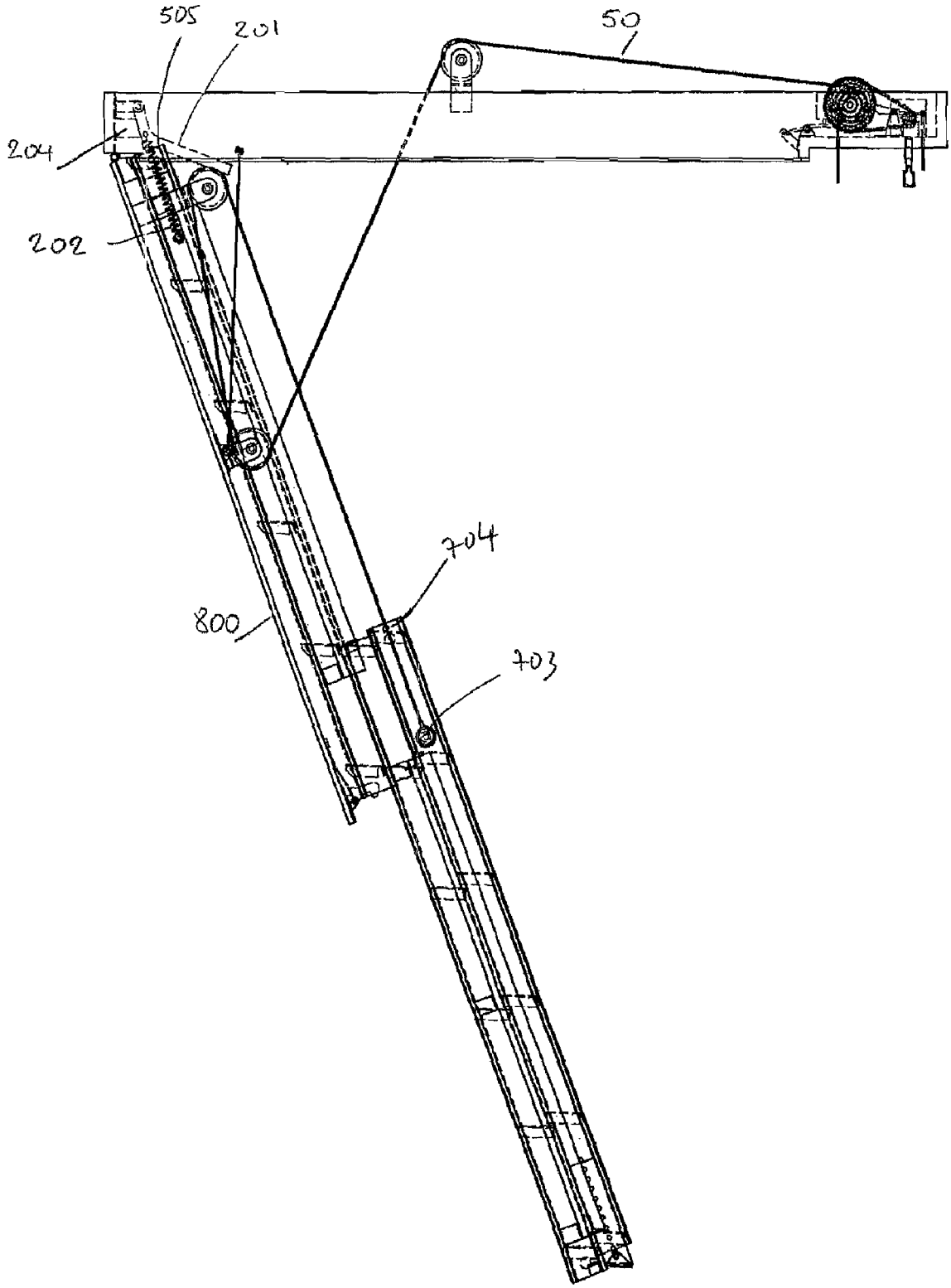
FIG. 7 is a side view of the access panel showing full extension of section 2 and partial extension of section 3, with the access panel being locked in its opened position.

With reference to FIG. 7, the mechanical locks 201 are pulled by springs 202 and have reached their latched position. The mechanical locks 201 are resting on their abutment fitting 204 that is mechanically attached to the forward end 13. The mechanical locks 201 are also resting on fittings 501 (See FIG. 9). In this position, the cover 800 and the ladder sections 500, 600, 700 are locked in the opened position because of the over center arrangement of the mechanical locks 201. Also in this position, the reaction force that the ladder section 500 communicates to the mechanical locks 201 is to further rotate the mechanical locks 201 towards an even more secure locked position, but this not possible as the abutment fittings 204 prevent the mechanical locks 201 from rotating further.

Figure 8:
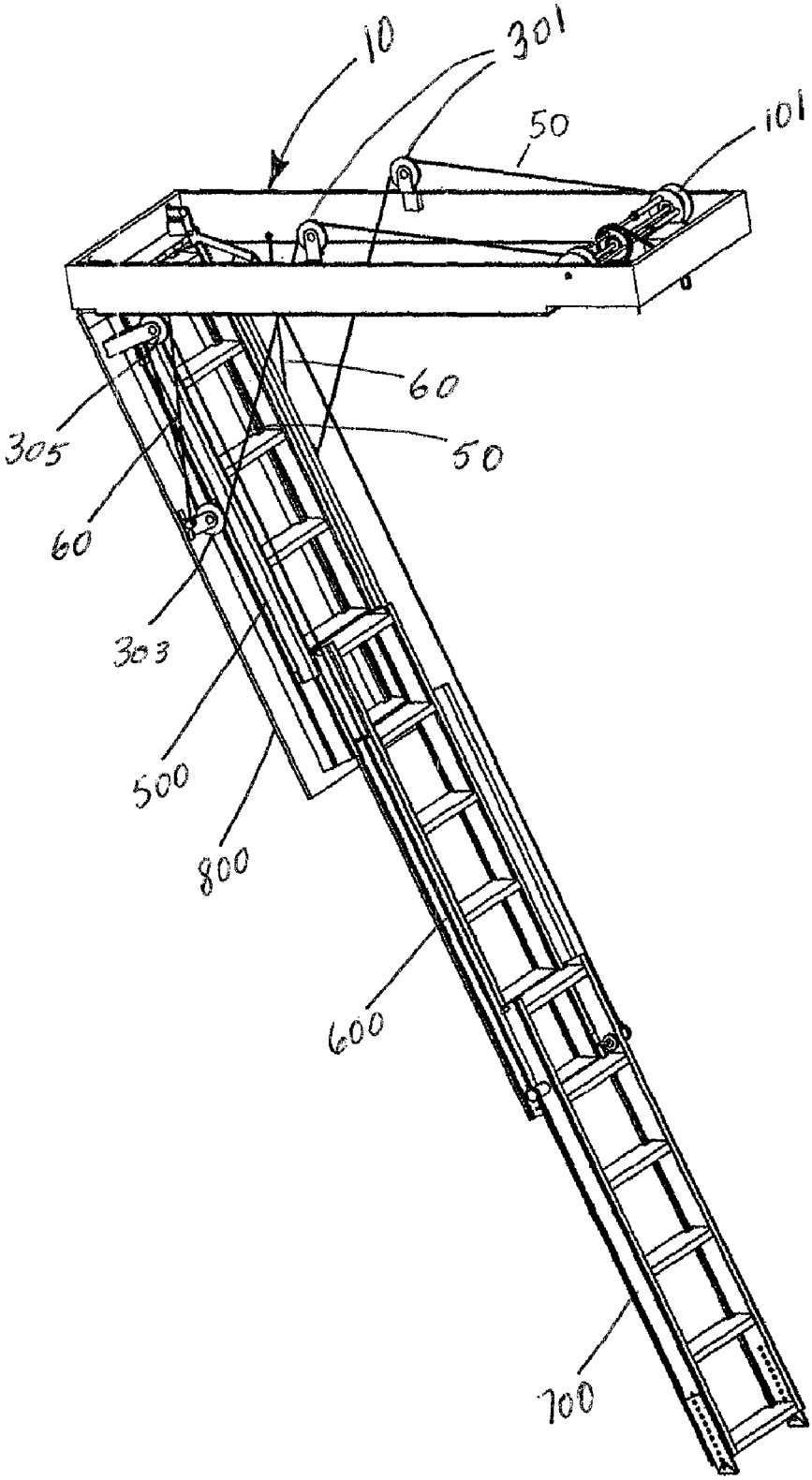
FIG. 8 shows a perspective view of the access panel in its fully extended position.

In reference to FIG. 8, the ladder sections 600 and 700 are fully extended. Cables 60 prevent further opening of cover 800. Operation of cables 50 with pulleys 301, 303 and 305 and reels 101 retract the ladder sections 600 and 700 and close the cover 800 as will be described hereinbelow.

Starting with FIG. 1, the access panel 30 is retracted and closed or stowed. To initiate the opening of the cover 800 of the access panel 30, one needs to press a switch in the living area (not shown) for energizing of the solenoid 223 that has its piston rod spring loaded in the retracted position (See FIG. 5). This action extends the piston rod of the solenoid 223 which then pivots the unlatching lever 221 of stow latch 225 towards its unlatched position. The unlatch lever 221 disengages stow latch 225 from its latch receptacle 220 mounted on the intermediate distal end 14 of the framing structure 10, and by gravity the cover 800 moves away from its latched position, but is stopped by the safety latch 211 that engages teeth of latch wheel 210, which is mechanically attached to one of the reels 101 (See FIG. 4). Energizing the solenoid 213 retracts its piston rod which pivots the safety lever 211 around its axis that is supported by clevis fitting 212. The piston rod of solenoid 213 is spring loaded in the extended position. Therefore, energization of the solenoid 213 must be maintained for the safety latch 211 to disengaged from the teeth of the wheel 210. The switch (not shown) that energized the solenoid 213 is a not an ON-OFF switch, but a switch that needs to be pressed and maintained pressed by the user to open the cover 800 and lower ladder sections 600 and 700. This is a safety characteristic of the invention, as the access panel 30 cannot accidentally fully open and fully extend unless the user has decided to do so. For example, this prevents the full opening of the access panel 30 and extension of the ladder sections 600 and 700, should solenoid 223 be accidentally energized by a child or anyone else or should the stow latch 225 break. In the event of an electrical failure, the stow latch 225 can be manually released by pulling on rope or chain 151 that goes through the floor 16 of the framing structure 10 (See FIGS. 3, 4, 5 and 6). Safety latch 211 can be manually released by pulling on rope or chain 152 (See FIGS. 4 and 6).

Once stow latch 225 is released and safety latch 211 is kept away from engaging the teeth of latch wheel 210, by gravity only, without energizing motor 109, the cover 800 and the ladder sections 500, 600, 700 keep on opening until the access panel 30 is fully opened to the position shown in FIG. 6 is reached. During this phase of the opening, it is gravity only that unrolls the cables 50 from their reels 101. Cover 800 has cables 60 to limit the opening of the panel access 30 to a predetermined angle typically ranging between 60 and 70 degrees. Still in reference to FIG. 6, mechanical locks 201 are pulled by their associated springs 202 that force the mechanical locks 201 to rotate around the pivoting axis of mounting devices 203 attached to forward end 13 of framing structure 10. The pivoting of mechanical lock 201 is also guided and limited by rods 704 attached to ladder section 700 (See FIGS. 6 and 11). In the position shown in FIG. 6, the mechanical locks 201 have not reached their locked position because they are still resting on rods 704 and are not resting on fittings 501 of ladder section 500.

Gravity effect on ladder sections 600 and 700 continues to unroll cables 50 from reels 101 until the ladder sections 600 and 700 reach the position shown in FIG. 7. The stops 603 of ladder section 600 (See FIG. 10) rest on step 740 of ladder section 700, so that when ladder section 700 is extending from the position of FIG. 6 to the position shown in FIG. 7, ladder section 600 follows in unison with ladder section 700. In the position of FIG. 7, the stops 602 of ladder section 600 (See FIG. 10) rest on the stops 502 of ladder section 500 (See FIG. 9) and, consequently, ladder section 600 has reached its fully extended position. As is also shown in FIG. 7, the mechanical locks 201 are no longer resting on rods 704 of ladder section 700 as mechanical locks 201 are pulled by associated springs 202 to their fully locked position. Mechanical locks 201 are now resting on fittings 501 of ladder section 500 (See FIG. 9) and on abutment fittings 204. In this position the cover 800 and its associated ladder sections 500, 600 and 700 are locked open and cannot be closed.

Figures 9, 10, 11:
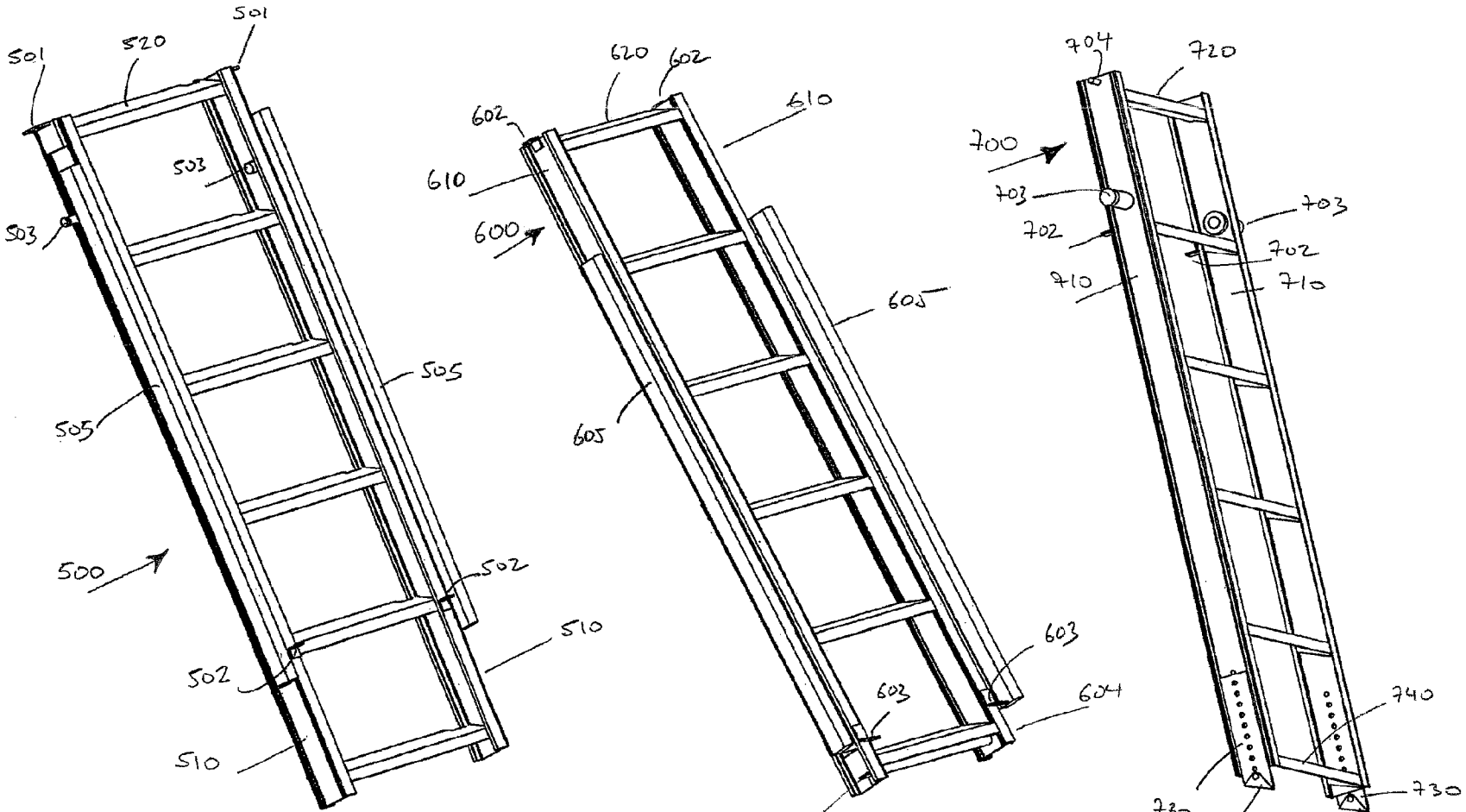
FIG. 9 shows perspective view of the first ladder section.
FIG. 10 shows a perspective view of the second ladder section.
FIG. 11 shows a perspective view of the third ladder section.

Gravity effect of ladder section 700 continues to unroll cables 50 from their reels 101 until stops 702 reach stops 604 of ladder section 600 (See FIG. 10). In this position the ladder sections 500, 600 and 700 have reached their fully extended position shown in FIG. 8. In order to slow down the speed of opening of the cover 800, and the speed of extension of the ladder sections 500, 600 and 700, a braking system 102 is installed on one of the reels 101 as will be described hereinbelow.

Figure 4:
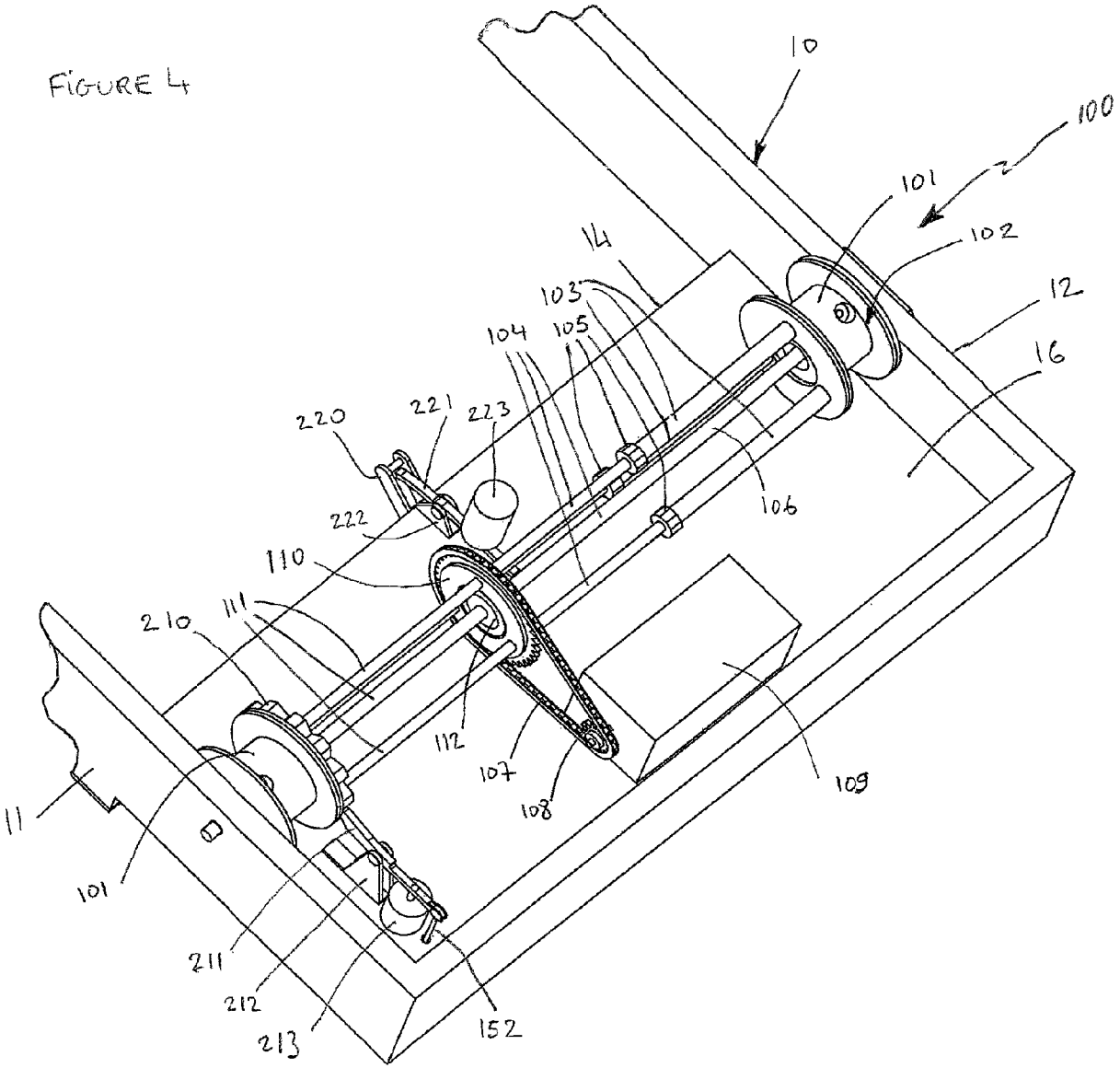
FIG. 4 is an enlarged partial perspective view of the rear portion of the framing structure shown in FIG. 3 and the driving mechanism.
Figure 4A:
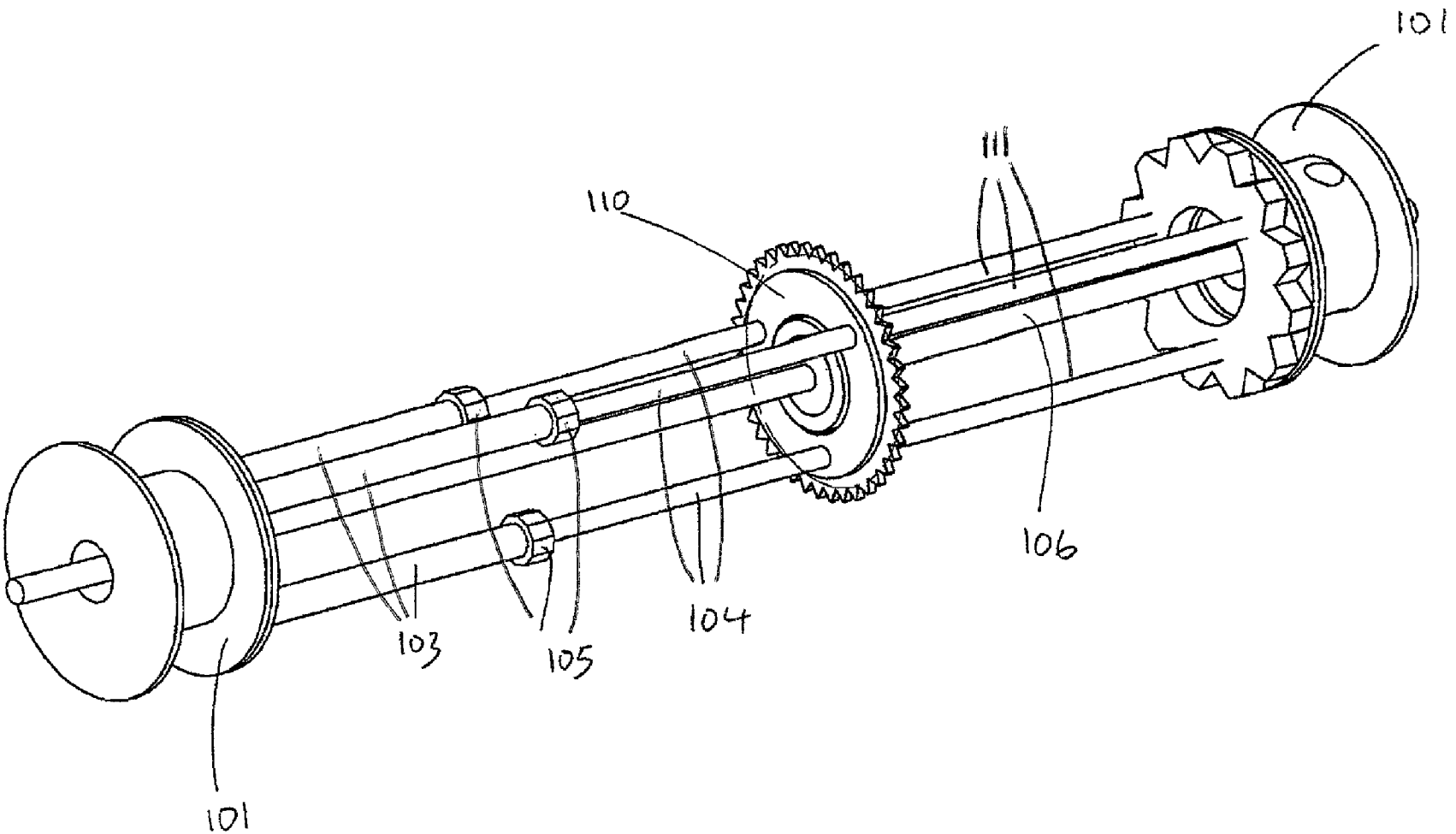
FIG. 4*a* is an enlarged perspective view of a portion of the apparatus shown in FIG. 4 for unrolling and rolling the cables.
Figure 4B:
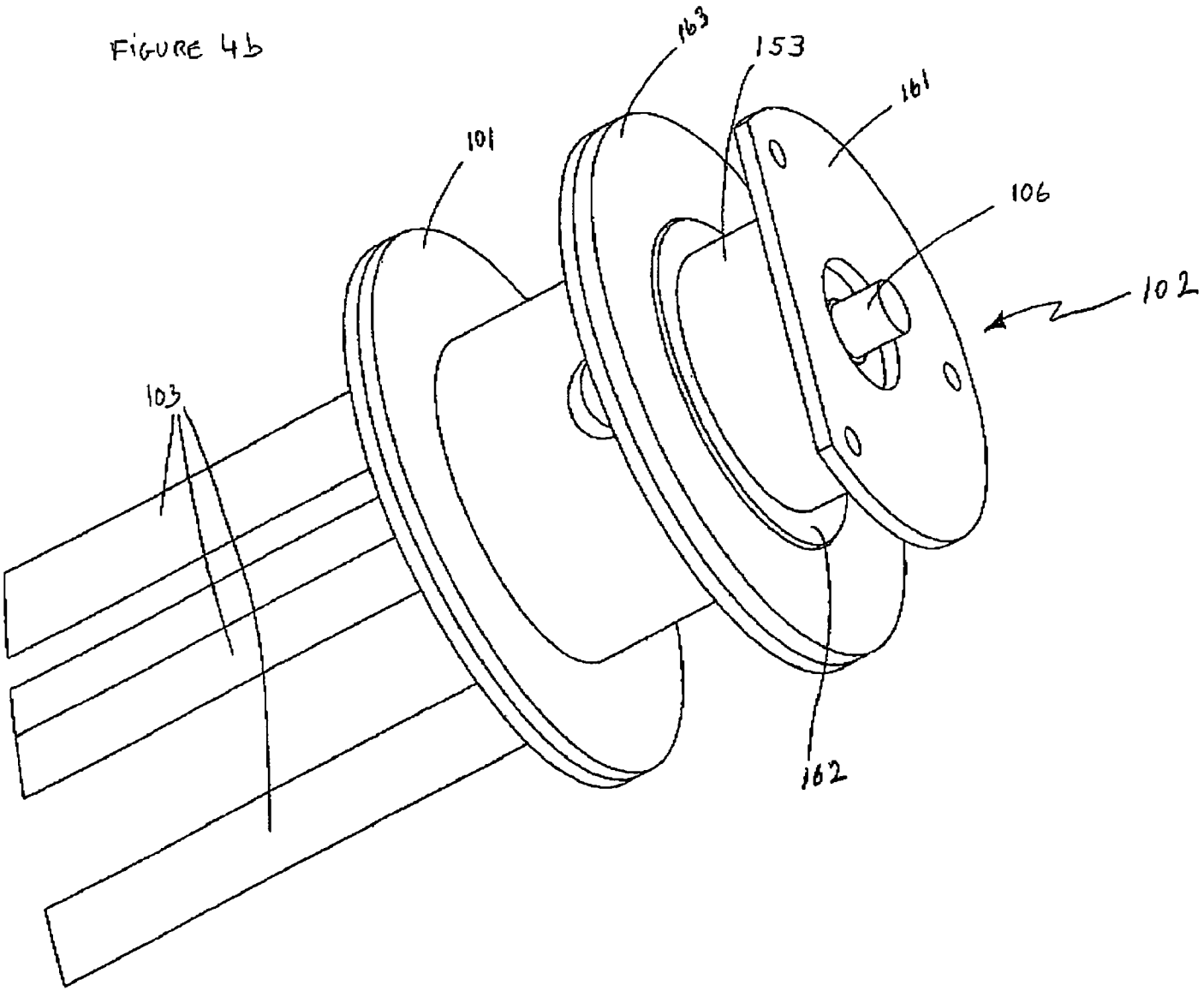
FIG. 4*b* is an enlarged partial perspective view of the brake shown in FIG. 4.

In reference to FIGS. 4 and 4*b* the longitudinal wall 12 of framing structure 10 is equipped with a braking system 102 that slows down the rotational speed of the reels 101 when the reels 101 unroll the cables 50 for the opening of the cover 800 and the extension of the ladder sections 500, 600, 700. The braking system 102 consists of a free wheel 162 whose inner shaft 153 is part of a flange 161 that is mechanically attached to side wall 12. The free wheel 162 supports a braking disk 163. The free wheel 162 is mounted such that it is not free to turn when the free wheel 110 is free to turn i.e., when the free wheel 110 is allowing the reels 101 to unroll the cables 50. In other words the free wheel 162 of the braking system 102 of the reels 101 is mounted in the opposite way compared to the free wheel 110. The friction force of reel 101 against braking disc 163 is adjusted through nuts 105 (See FIG. 4).

As shown in FIGS. 8 and 11, ladder section 700 is equipped with adjustable legs 730, fitted with rotating shoes 731 to ensure perfect contact with the ground when the ladder sections are fully extended.

Figure 5:
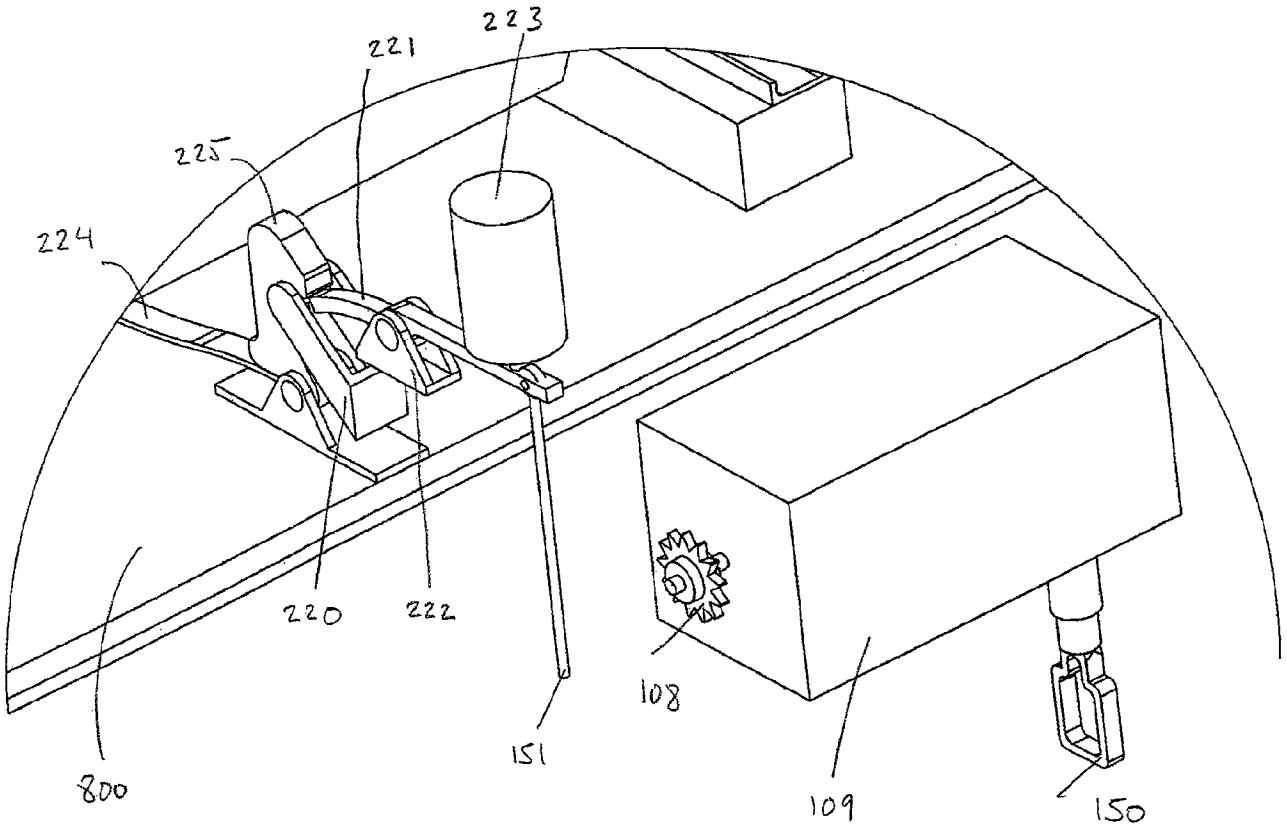
FIG. 5 is an enlarged perspective view of the stow latch of the apparatus in the latched and stowed position.

As previously described, the opening of the cover 800 and the extending of the ladder sections 500, 600, 700 is only achieved through gravity. The retraction of the ladder sections 500, 600, 700 and the closing of the cover 800 is achieved via the assistance of a motor. Starting from the position shown in FIG. 8, the motor 109 shown in FIGS. 4 and 5 is energized via a switch (not shown) in the living area that closes the circuit of the electrical connections of the motor 109 to an electrical power source (not shown). A mechanical device 150 is connected to the motor 109. No further description of this is provided as this is very well known in the art. Pinion 108 mounted on the shaft of the motor 109 drives a chain 107 that, is connected to a single gear free wheel 110. A single gear free wheel 110 is driven by the chain 107 in only one direction of rotation, but is free to rotate in the opposite direction to unroll the cables 50. The driven rotation of single gear free wheel 110 corresponds to rolling cables 50 on their respective reels 101. As shown in FIGS. 4 and 4*a* one of reels 101 is connected to the single gear free wheel 110 via a plurality of fixed rods 11 1, while the other reel 101 is connected to single gear free wheel 110 via a plurality of adjustable rods 103 and 104, the adjustment being carried out through nuts 105. The single gear free wheel 110 is mechanically attached to a center shaft 106 that is supported by the longitudinal walls 11 and 12 of the framing structure 10.

The motorized drive of the single gear free wheel 110 in the direction of rolling up the cables 50 on their respective reels 101 continues until the ladder section 700 reaches the position shown in FIG. 7. At such point, step 740 of ladder section 700 (See FIG. 11) meets with stops 603 of ladder section 600 (See FIG. 10). Thereafter, further reeling in of cables 50 further retracts ladder section 700 and pulls with it ladder section 600 towards their retracted position. When ladder section 700 approaches its fully retracted position, its rods 704 meet with locks 201 and drives locks 201 towards the unlatched position. At such point as the position shown in FIG. 6 is reached, the ladder sections 500, 600, 700 are fully retracted, but the cover 800 is unlatched and ready to be closed by the further rolling up of the cables 50 on their reels 101 to reach the closed position. When the cover 800 is approaching the closed position, stow latch 225, via spring 224, meets its latch receptacle 220 (See FIG. 5) forcing stow latch 225 to re-latch. During the complete rolling up sequence of the cables 50, the teeth of the latch wheel 210 rotate the safety latch 211 away from its latching position (See FIG. 4). Once the access panel 30 is fully re-latched, it is in the configuration shown on FIGS. 1 and 2 and the electric motor is automatically de-energized, via known means such as electrical load currents for example.

During the complete retraction of the ladder sections 500, 600, 700 and the closing of the cover 800, the braking system 102 offers no resistance as it is free to rotate in the direction of rolling up the cables 50.

In reference to FIGS. 9, 10, and 11 ladder sections 500, 600, 700 are respectively fitted with a series of steps 520, 620, 720 that provides comfort and safety to the user. For instance the steps 520, 620, 720 may be covered with a non slippery surface. In addition for ease of climbing, ladder sections 500, 600 are respectively fitted with railing 505, 605 (See FIGS. 9 and 10).

The invention uses only the motor 109 to retract the ladder sections 500, 600, 700 and close the cover 800. Only gravity is used to open the cover 800 of access panel 30 and extend the ladder sections 500, 600, 700 as previously described.

Figure 13:
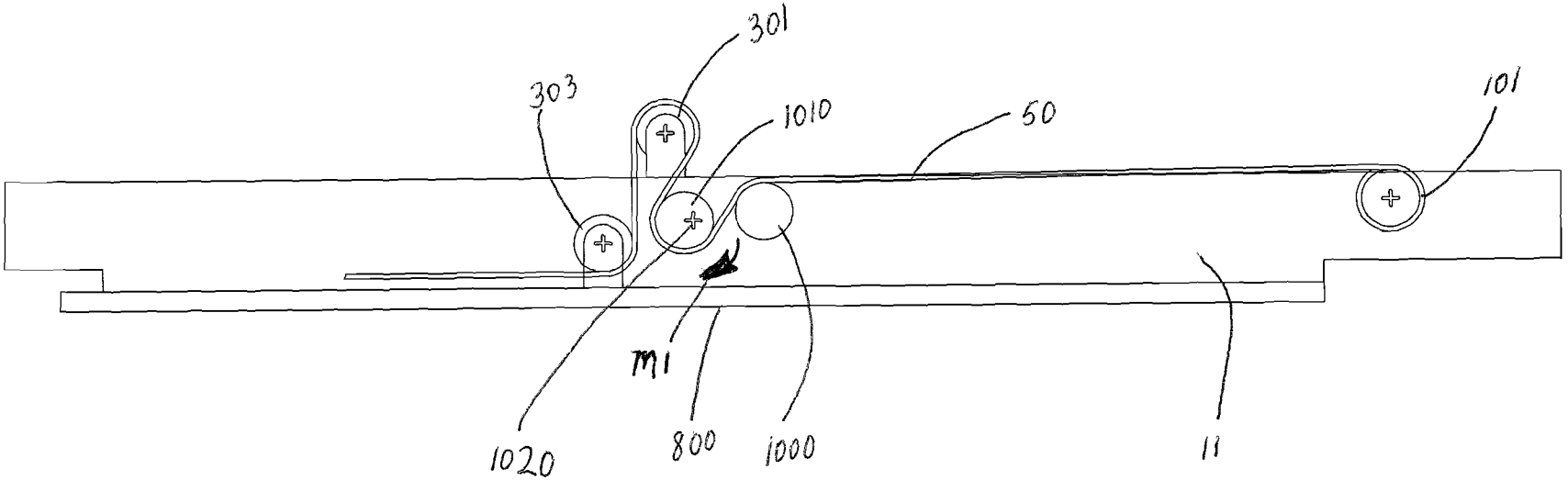
FIG. 13 is a partial side view of a different braking system with the ladder section removed and the access panel being closed.

FIG. 13 shows the cover 800 on which the ladder sections 500, 600, 700 (not shown for clarity) are mechanically attached and in their stored position adjacent longitudinal side 1l. Longitudinal side 11 is equipped with at least one off center pivoting cam 1010 on axis 1020 and a fixed cam 1000. Pivoting cam 1010 can either take the off center position shown in FIG. 13, or the off center position shown on FIG. 14. The cable 50, through the weight of the cover 800 and ladder sections 500, 600, 700, produces counter clockwise pivoting motion MI that forces off center pivoting cam 1010 to stay in its position shown in FIG. 13. Cable 50 is free, i.e., not squeezed between off center pivoting cam 1010 and fixed cam 1000.

Figure 14:
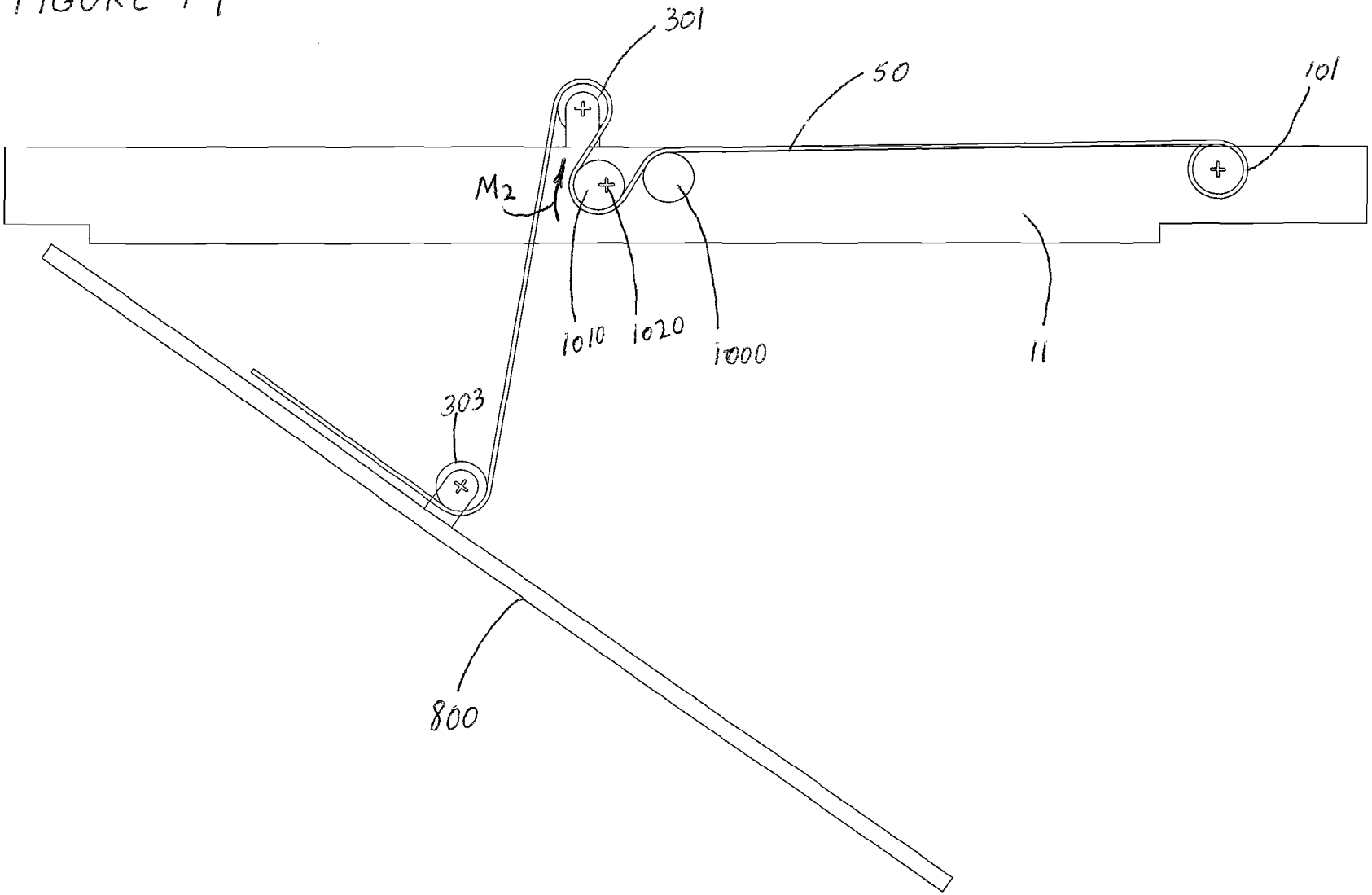
FIG. 14 is a partial side view of FIG. 13 with the ladder sections removed and the access panel being open.

In FIG. 14, the ladder sections 500, 600, 700 have started their deployment and cable 50, through gravity, produces clockwise pivoting motion M2 to the off center pivoting cam 1010 which makes it rotate around axis 1020 and, consequently, applies a braking pressure force to said cable 50 against the fixed cam 1000. Gravity feed is consequently slowed down by the braking pressure force on cable 50 between off center pivoting cam 1010 and fixed cam 1020.

This arrangement shown and described in connection with FIGS. 13 and 14 has the benefit to easily control the speed of opening of the ladder sections 500, 600 and 700 and their fall to the ground. It can be used as a stand alone, or in combination with the devices that control the lowering down of the ladder to the ground.

What is claimed:

1. An automated access panel for installation in an opening in a ceiling to provide access to a space above the ceiling, the automated access panel comprising:

a framing structure for installation in said opening;

a cover for closing said opening, said cover being pivotally attached to a first end of said framing structure;

a plurality of slidably extendable ladder sections, a first of said slidably extendable ladder sections being mounted on said cover and a second of said slidably extendable ladder sections being slidably with respect to said first of said slidably extendable ladder sections;

a motor connectable to an energy source;

a cable connecting between a reel and at least one of said plurality of said slidably extendable ladder sections;

a free wheeling gear including a first part coupled to said reel and a second part coupled to said motor, said free wheeling gear (a) allowing for gravity to rotate said first part in a lowering direction to open said cover and lower said plurality of said slidably extendable ladder sections, said second part adapted to freely rotate relative to said first part when said first part is prevented from rotating in the lowering direction so that said cable does not continue to unwind from said reel, and said free wheeling gear (b) adapted to be driven by said motor to rotate said second part in a raising direction opposite said lowering direction, said second part adapted to engage said first part when said motor drives said second part in the raising direction to wind up said cable about said reel which retracts said plurality of said slidable extendable ladder sections.

2. The automated access panel of claim 1, further comprising a brake for said reel to prevent excessive speed of said cable during said opening of said cover and lowering of said plurality of said slidably extendable ladder sections.

3. The automated access panel of claim 2, wherein a braking force exerted by said brake is adjustable.

4. The automated access panel of claim 3, wherein said braking force is provided by a pivoting cam forcing said cable against a fixed cam, both of said cams being mounted on said framing structure.

5. The automated access panel of claim 1, further comprising a floor on one end of said framing structure to support said motor thereon.

6. The automated access panel of claim 5, wherein said framing structure is substantially rectangular with a pivot of said cover being at the first end of said framing structure and said motor being at a second end of said framing structure.

7. The automated access panel of claim 1, wherein said cable and said reel are on a side of said framed structure, said cable is directed through pulleys so that said cable is substantially vertical when closing said cover to exert the maximum lifting force on said cover with the least amount of energy.

8. The automated access panel of claim 1, further comprising a seal between said cover and said framing structure to create an environmental seal around said opening in said ceiling.

9. The automated access panel of claim 1, wherein the second part is a toothed wheel.

10. The automated access panel of claim 9, wherein the second part is coupled to the motor via a chain,

11. The automated access panel of claim 1, wherein the first part and the second part of the free wheeling gear and the reel rotate in unison when the cover pivots toward a closing position.

12. The automated access panel of claim 1, wherein the free wheeling gear and the reel are mounted on a common shaft.

13. The automated access panel of claim 1, comprising a latching mechanism configured to hold said cover in a closed position once said motor is de-energized.

14. The automated access panel of claim 13, wherein said latching mechanism includes a stow latch between said framing structure and said cover to hold said cover in a closed position.

15. The automated access panel of claim 14, further comprising a safety latch that is manually, or electronically, or both manually and electronically openable, said safety latch preventing said reel from rotating to lower said plurality of said slidable extendable ladder sections unless desired.

16. The automated access panel of claim 15, wherein a mechanical lock keeps said cover open until a lower most of said slidably extendable ladder section is raised.

17. The automated access panel of claim 5, wherein said stow latch and said safety latch are automatically latched when said cover is closed.

18. The automated access panel of claim 14, wherein said stow latch can be operated manually, or electronically, or both manually and electronically.

19. The automated access panel of claim 13, wherein said latching mechanism is unlatched when said free wheeling gear rotates in the lowering direction and in the raising direction.

20. The automated access panel of claim 13, wherein said latching mechanism is configured to automatically latch the access panel when said access panel has reached the closed position.

21. An automated access panel for installation in an opening in a ceiling to provide access to a space above the ceiling, the automated access panel comprising:

a cover for said opening, said cover being pivotable between a first position in which said cover is deployed so as to allow access to the space through the opening and a second position in which the cover substantially covers said opening;

a plurality of slidably extendable ladder sections, a first of said slidably extendable ladder sections being mounted on said corer and a second of said slidably extendable ladder sections being slidable with respect to said first of said plurality of slidably extendable ladder sections;

a motor;

a reel coupled to at least one of said plurality of slidably extendable ladder sections via a cable;

a free wheeling gear coupled to said reel and said motor, a first part of the free wheeling gear is coupled to said reel and is disengaged from said motor when rotating in a first rotating direction to allow for gravity to pivot the cover toward the first position and lower said plurality of said slidably extendable ladder sections, said first part being driven by said motor when rotating in a second rotating direction, opposite the first rotating direction, to allow for said motor to allow for said motor to wind up said cable around said reel so as to retract said plurality of said slidably extendable ladder sections and pivot the cover toward the second position.

22. The automated access panel of claim 21, wherein the free wheeling gear and the reel are mounted on a common shaft.

23. The automated access panel of claim 21, further comprising a framing structure for installation in said opening, wherein the cover is pivotally attached to an end of said framing structure.

24. The automated access panel of claim 21, comprising a latching mechanism configured to hold said cover in the second position once said motor is de-energized.

25. The automated access panel of claim 24, wherein said latching mechanism is unlatched when said free wheeling gear rotates in the first rotating direction and in the second rotating direction.

26. The automated access panel of claim 21, wherein said free wheeling gear includes a second part coupled to said motor, said second part adapted to engage said first part when rotating in the second rotating direction to allow for said motor to wind up said cable around said reel.

27. The automated access panel of claim 26, wherein the second part is a toothed wheel.

28. The automated access panel of claim 26, wherein the second part of the free wheeling gear is coupled to the motor via a chain.

29. The automated access panel of claim 26, wherein the first part and the second part of the free wheeling gear and the reel rotate in unison when the cover pivots toward the second position.

* * * * *